US005477686A

United States Patent [19]

Minas

[11] Patent Number: 5,477,686

[45] Date of Patent: Dec. 26, 1995

[54] TUNED SPLIT-STIRLING CRYOREFRIGERATOR

[75] Inventor: Constantinos Minas, Slingerlands, N.Y.

[73] Assignee: Martin Marietta Corporation, Syracuse, N.Y.

[21] Appl. No.: 240,129

[22] Filed: May 10, 1994

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 3,906,739 9/1975 Raimondi ..... 62/6

OTHER PUBLICATIONS

"Dynamic Modelling of Stirling Cryorefrigerator", C. Minas, Cryogenics, 1994, vol. 34, No. 1, pp. 37–41.

Cryocoolers Part 1: Fundamentals, Graham Walker, The University of Clagary, Calgary, Alberta, Canada, 1983 Plenum Press, New York and London, pp. 119, 121,169–171.

Cryogenic Technology, John Wiley & Sons, Inc., New York and London, 1963, pp. 18–21.

*Primary Examiner*—Ronald C. Capossela

*Attorney, Agent, or Firm*—Paul Checkovich; Stephen A. Young

[57] ABSTRACT

A split-Stirling cryorefrigerator including a cylinder containing a movable displacer containing regenerator material and having an attached movable rod with a free end located in a housing enclosing a gas-spring chamber containing a gas. The cylinder has an orifice near its warm end which is in fluid communication with a gas source having a cyclic (typically sinusoidal) pressure. The movable rod slidably and generally sealably engages the housing and the warm end of the cylinder. The cryorefrigerator also includes a mechanism for adjusting the void volume of the gas-spring chamber, such adjustment allowing for increased cooling capacity of the cryorefrigerator when the amplitude of the cyclic pressure of the gas source is increased.

7 Claims, 4 Drawing Sheets

TUNED SPLIT-STIRLING CRYOREFRIGERATOR

This invention was made with Government support under Government Contract No. N00019-C-0223 awarded by the Navy. The Government has certain rights in this invention.

BACKGROUND OF THE INVENTION

The present invention relates generally to a cryorefrigerator, and more particularly to a split-Stirling cryorefrigerator which can be tuned for efficient cooling over a range of operating conditions.

Cryorefrigerators (also known as cryocoolers) are used for low temperature cooling. Known cryorefrigerators include Stirling-cycle cryorefrigerators, such as split-Stirling cryorefrigerators. A split-Stirling cryorefrigerator is ordered from a manufacturer based on a required temperature and cooling capacity. In a typical split-Stirling cryorefrigerator, there is a helium gas source having a gas pressure which varies sinusoidally about a predetermined pressure. It is known that the amplitude of such sinusoidal pressure (i.e., the difference between the minimum and maximum pressure) helps determine the cooling capacity (expressed in Watts) of the cryorefrigerator. However, attempts at increasing the cooling capacity of a manufactured split-Stirling cryorefrigerator by increasing the amplitude of the sinusoidal pressure of the gas source led, paradoxically, to a decreased cooling capacity. In fact, in many such attempts, the cryorefrigerator completely stopped operating and had no cooling capacity at all!

SUMMARY OF THE INVENTION

It is an object of the invention to provide a split-Stirling cryorefrigerator which will increase its cooling capacity when the amplitude of the cyclic pressure of its gas source is increased.

The split-Stirling cryorefrigerator of the invention includes a cylinder, a housing, and a displacer assembly. The cylinder has a first end for warm end compression, a second end for cold end expansion, and an orifice which is located near the first end and which is in fluid communication with a gas source having a cyclic pressure. The housing encloses a gas-spring chamber containing a gas. The displacer assembly includes a movable displacer and a movable rod; wherein the movable displacer contains regenerator material, is located within the cylinder, and is movable from a center position equal maximum distances towards the first end and towards the second end; wherein the movable rod has a free end located within the housing and an attached end located within the cylinder and attached to the movable displacer; and wherein the movable rod slidably and generally sealably engages the housing and the first end of the cylinder. A mechanism is supplied for adjusting the void volume of the gas-spring chamber.

In a first preferred embodiment, the void-volume-adjusting mechanism includes a temperature sensor, a first linear-variable-differential transformer (LVDT), and a first controller. The temperature sensor is for sensing the temperature of the second end of the cylinder, the first LVDT has a movable shaft extending into the chamber, and the first controller is for moving the movable shaft of the first LVDT to adjust the void volume of the chamber so as to generally minimize the temperature.

In a second preferred embodiment, the void-volume-adjusting mechanism includes a proximity sensor, a second LVDT, and a second controller. The proximity sensor is connected to the housing for measuring the distance to the free end of the movable rod, the second LVDT has a movable shaft extending into the chamber, and the second controller is for moving the movable shaft of the second LVDT to adjust the void volume of the chamber so as to make the motion of the free end of the movable rod generally centered about its center position.

Several benefits and advantages are derived from the invention. Adjusting the void volume of the gas-spring chamber (such as with either of the two previously-described void-volume-adjusting mechanisms) allows a manufactured split-Stirling cryorefrigerator to have its cooling capacity increased above its manufactured level when the amplitude of the cyclic pressure of its gas source is increased. Thus, the invention provides a split-Stirling cryorefrigerator which can be tuned for efficient cooling over a range of operating conditions.

BRIEF DESCRIPTION OF THE DRAWINGS

The accompanying drawings illustrate several preferred embodiments of the present invention wherein.

DETAILED DESCRIPTION OF THE INVENTION

Figure 1:
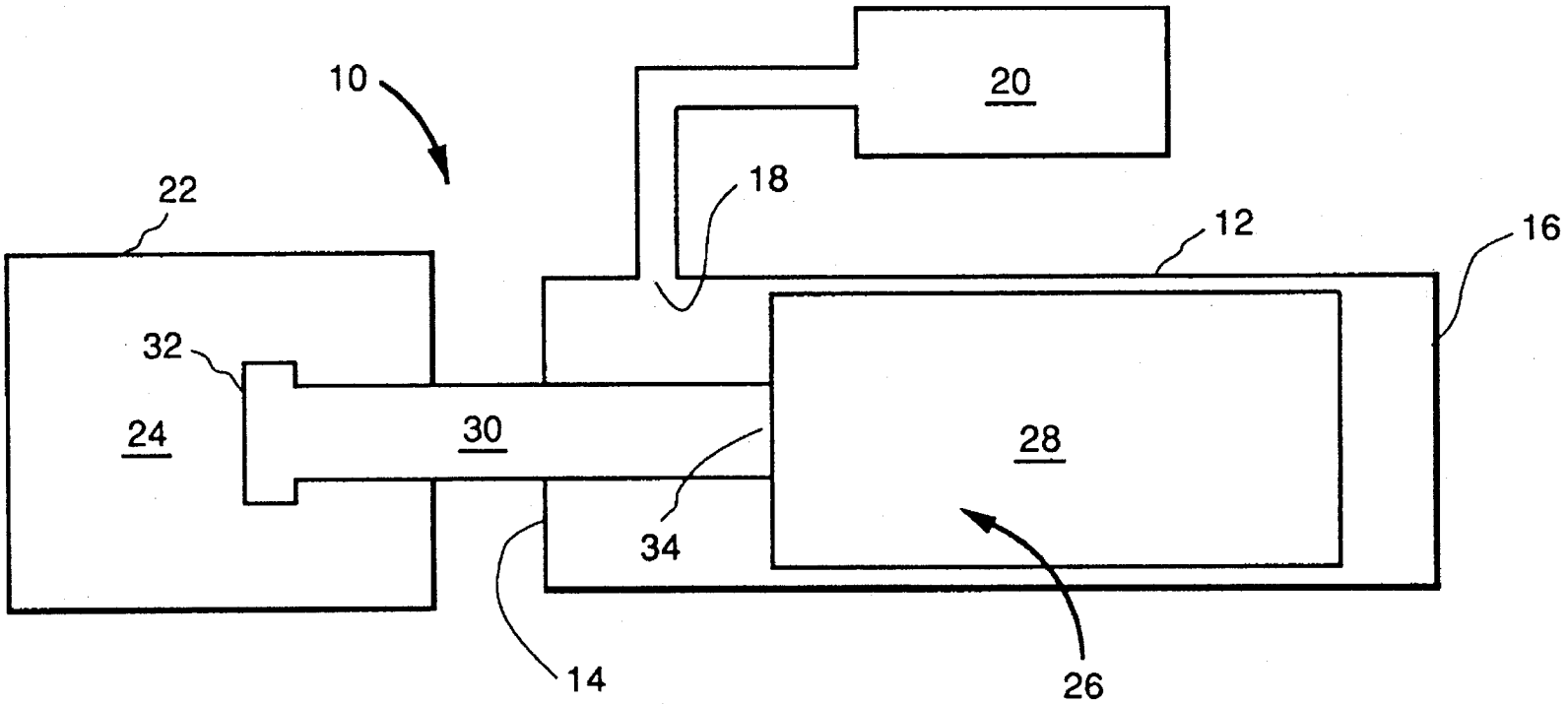
FIG. 1 (PRIOR ART)
FIG. 1 is a schematic view of a prior art split-Stirling cryorefrigerator.

Referring now to the drawings, wherein like numerals represent like elements throughout, FIG. 1 shows a conventional split-Stirling cryorefrigerator 10 including a cylinder 12 having a first end 14 for warm end compression, a second end 16 for cold end expansion, and an orifice 18 which is disposed proximate the first end 14 and which is in fluid communication with a gas source 20 having a cyclic pressure. A typical temperature for the second end 16 would be 70 Kelvin, and a typical gross cooling capacity would be 1.74 Watts. The gas source 20 typically contains helium gas at room temperature and has a piston (not shown) which moves to vary the pressure of the helium gas generally sinusoidally about some reference (predetermined) pressure. For example, the pressure may vary sinusoidally from about 6.0 to about 7.2 mega-Pascales (MPa), which corresponds to a reference pressure of 6.6 MPa and an amplitude of 1.2 MPa. The conventional split-Stirling cryorefrigerator 10 also includes a housing 22 enclosing a gas-spring chamber 24 containing a gas (typically helium gas at room temperature and at a pressure, for example, of 6.6 MPa), and further includes a displacer assembly 26. The displacer assembly 26 includes a movable displacer 28 and a movable rod 30. It is noted that movement of the movable rod 30 will vary the pressure of the gas in the gas-spring chamber 24 about its mean pressure. The movable displacer 28 contains regenerator material (such as bronze or stainless steel wire mesh screens or lead spheres), is disposed within the cylinder 12, and is movable from a center position equal maximum distances towards the first end 14 and towards the second end 16. The movable rod 30 has a free end 32 disposed within the housing 22 and an attached end 34 disposed within the cylinder 12 and attached to the movable displacer 28. The movable rod 30 slidably and generally sealably engages the housing 22 and the first end 14 of the cylinder 12 (such seals being omitted from the drawings for clarity).

Before Applicant's invention, attempts to increase the cooling capacity of a split-Stirling cryorefrigerator 10 by increasing the amplitude of the pressure of the gas source 20 failed. Typically, a temperature sensor (not shown) was placed at the second end (cold end) 16 of the cylinder 12, and the amplitude was increased to try to increase cooling capacity. Unexpectedly, the cooling capacity decreased. Typically, the movable displacer 28 slowed down and then stopped moving so that the conventional split-Stirling cryorefrigerator 10 had no cooling capacity at all!

Applicant discovered that in order to make a manufactured split-Stirling cryorefrigerator work at an increased cooling capacity by increasing the amplitude of the cyclic pressure of its gas source, it is necessary to modify the void volume of the gas-spring chamber 24 so that the motion of the movable displacer 28 in the cylinder 12 is centered about its center position. By centered motion is meant that the movable displacer 28 moves equal distances from its center position towards the first (warm) end 14 and towards the second (cold) end 16. Such centered motion will minimize the temperature of the second (cold) end 16 of the cylinder 12.

Applicant published a paper entitled "Dynamic modelling of Stirling cryorefrigerator" in Cryogenics 1994, Volume 34, Number 1, pages 37–41, which is hereby incorporated by reference. Such paper presents the theoretical formulation of Applicant's invention. Applicant has performed computer simulations based on the paper showing that Applicant's invention does increase the cooling capacity. In one computer simulation, the void volume of the chamber 24 was adjusted from 1.26 to 0.16 cubic centimeters which increased the gross cooling capacity from 1.74 to 1.87 Watts. One of ordinary skill in the art can determine the required void volume of the gas-spring chamber 24 for a desired amplitude of the gas pressure of the gas source 20 from Applicant's paper, but more preferred methods will be hereinafter described.

Based on Applicant's discovery, the split-Stirling cryorefrigerator of Applicant's invention includes all of the previously disclosed elements of the conventional cryorefrigerater 10 of FIG. 1 plus means for adjusting the void volume of the gas-spring chamber 24.

Figure 2:
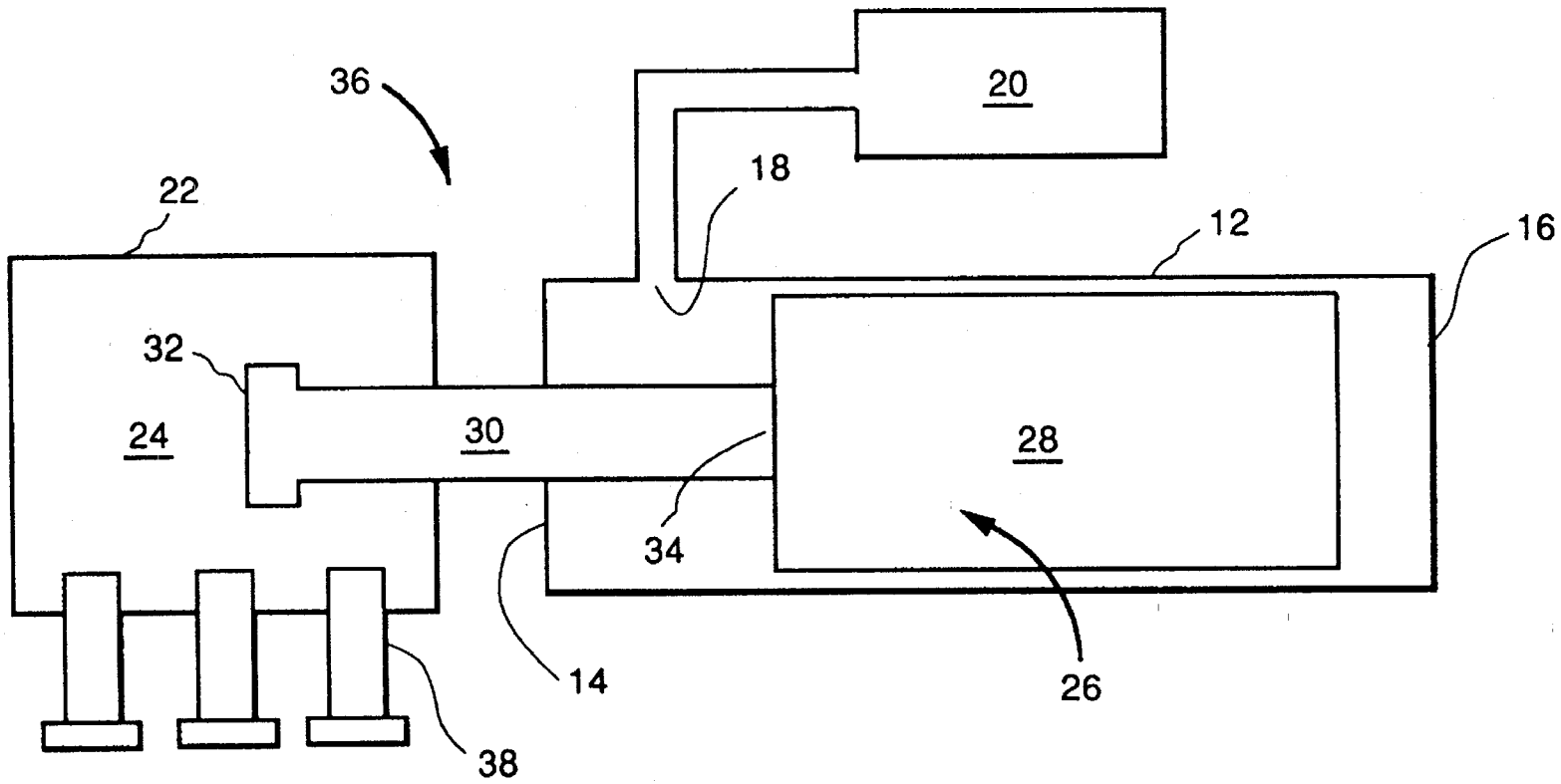
FIG. 2 is a schematic view of the split-Stirling cryorefrigerator of the invention wherein the mechanism for adjusting the void volume of the gas-spring chamber includes adjustment bolts.

In an exemplary embodiment of the split-Stirling cryorefrigerator 36 of the invention, as shown in FIG. 2, the void-volume-adjusting means includes adjustment bolts 38 extending into the gas-spring chamber 24. When the amplitude of the pressure of the gas source 20 is increased in an attempt to increase cooling capacity, the movable displacer 28 will no longer have centered motion. The adjustment bolts 38 may be adjusted manually based on a visual inspection of the motion of the movable rod 30 until motion of the movable rod 30 corresponding to centered motion of the movable displacer 28 is achieved, or the adjustment bolts 38 may be adjusted according to calculations based on the previously-discussed paper. For example, the adjustment bolts 38 may be adjusted once at the beginning of the operation of the cryorefrigerator 36 based on a visual determination of the motion of the movable rod 30 corresponding to centered motion of the movable displacer 28. It is noted that motion of the movable rod 30 does not affect the void volume (i.e., the volume not traversed by the movable rod 30) of the gas-spring chamber 24.

Figure 3:
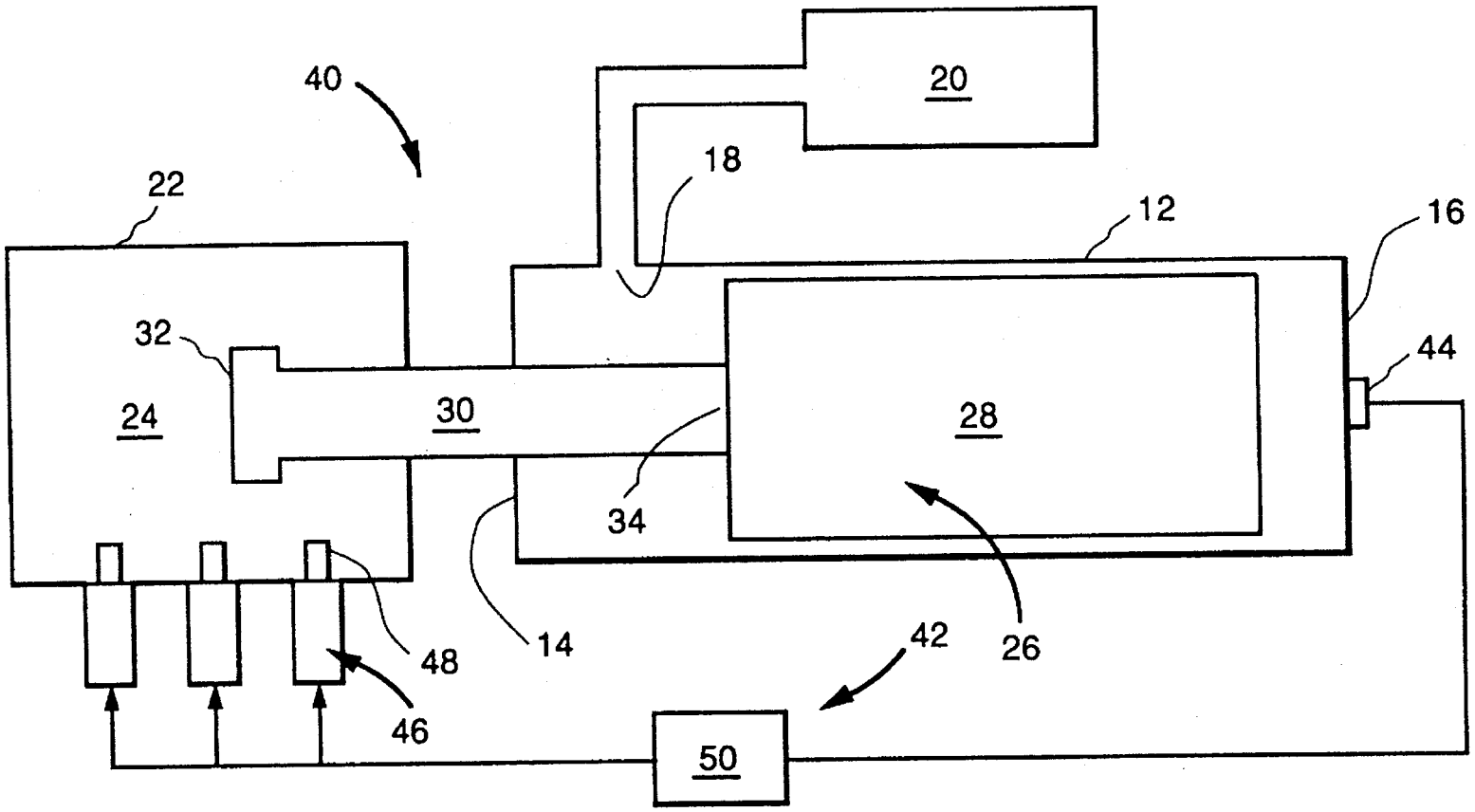
FIG. 3 is a schematic view of the split-Stirling cryorefrigerator of the invention wherein the mechanism for adjusting the void volume of the gas-spring chamber includes a first linear-variable-differential transformer and a temperature sensor.

In a first preferred embodiment of the split-Stirling cryorefrigerator 40 of the invention, as shown in FIG. 3, the void-volume-adjusting means includes means 42 for adjusting the void volume of the gas-spring chamber 24 so as to generally minimize the temperature of the second (cold) end 16 of the cylinder 12. Preferably, such means 42 includes a temperature sensor 44 for sensing the temperature of the second (cold) end 16 of the cylinder 12, a first linear-variable-differential transformer (LVDT) 46 having a movable shaft 48 extending into the gas-spring chamber 24, and a first controller 50 for moving the movable shaft 48 of the first LVDT 46 to adjust the void volume of the gas-spring chamber 24 so as to generally minimize such temperature. The first controller 50 can be a digital or analog computer or control circuit (or the like) programmed or wired according to known feedback-control principles, as is within the skill of the artisan. Other linear motion devices can be used in place of the first LVDT 46, as can be appreciated by those skilled in the art. Preferably, such void-volume-adjusting means 42 adjusts the void volume of the gas-spring chamber 24 during the operation of the cryorefrigerator 40 instead of just adjusting the void volume once at startup. Such void-volume adjustments can be made periodically or continuously.

Figure 4:
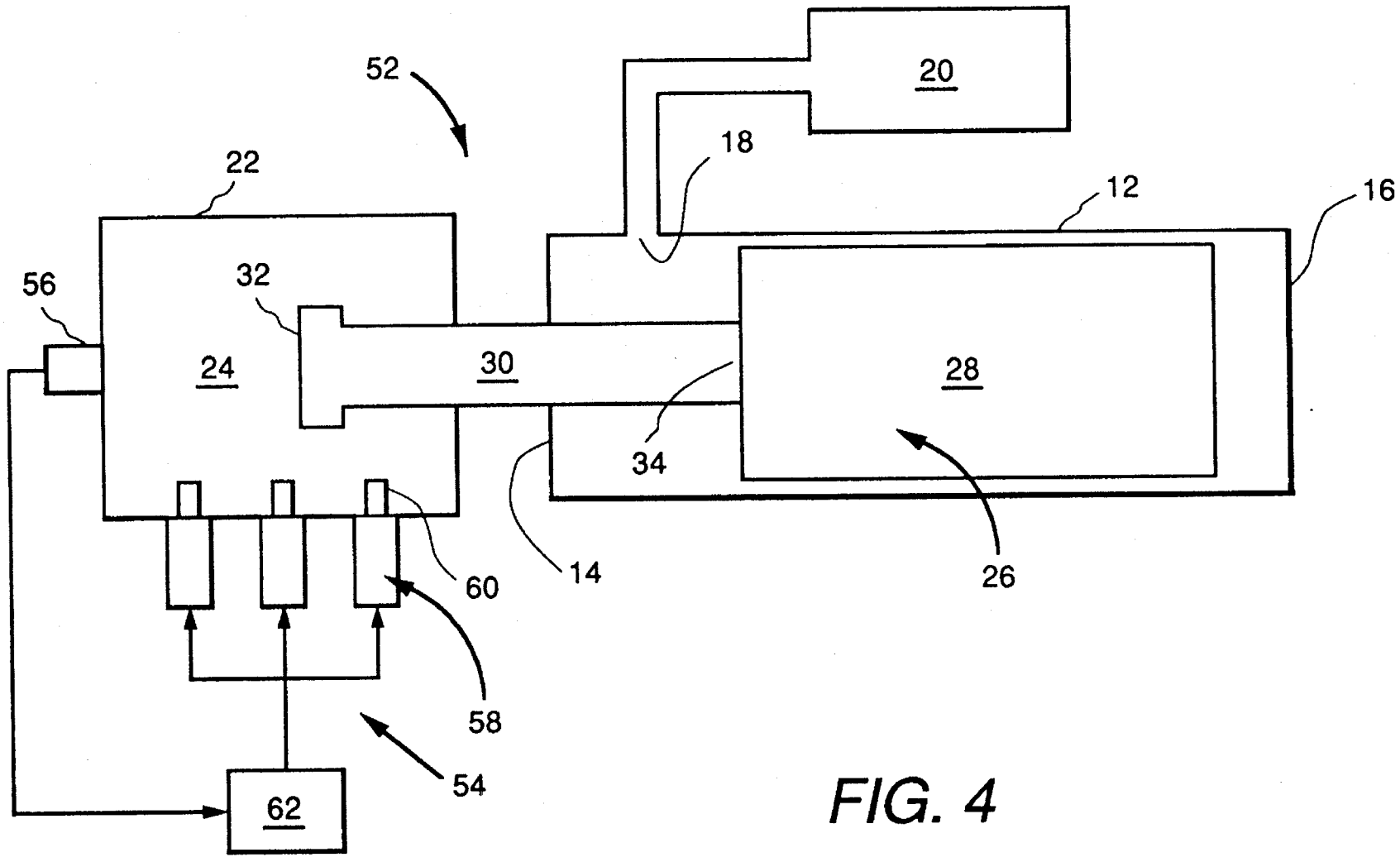
FIG. 4 is a schematic view of the split-Stirling cryorefrigerator of the invention wherein the mechanism for adjusting the void volume of the gas-spring chamber includes a second linear-variable-differential transformer and a proximity sensor.

In a second preferred embodiment of the split-Stirling cryorefrigerator 52 of the invention, as shown in FIG. 4, the void-volume-adjusting means includes means 54 for adjusting the void volume of the gas-spring chamber 24 so as to make the motion of the the movable displacer 28 generally centered about its center position. Preferably, such means 54 includes a proximity sensor 56 connected to the housing 22 for measuring the distance to the free end 32 of the movable rod 30, a second linear-variable-differential transformer (LVDT) 58 having a movable shaft 60 extending into the gas-spring chamber 24, and a second controller 62 for moving the movable shaft 60 of the second LVDT 58 to adjust the void volume of the gas-spring chamber 24 so as to make the motion of the free end 32 of the movable rod 30 correspond to motion of the movable displacer 28 which is generally centered about its center position. The second controller 62 can be a digital or analog computer or control circuit (or the like) programmed or wired according to known feedback-control principles, as is within the skill of the artisan. Other linear motion devices can be used in place of the second LVDT 58, as can be appreciated by those skilled in the art. Preferably, such void-volume-adjusting means 54 adjusts the void volume of the gas-spring chamber 24 during the operation of the cryorefrigerator 52 instead of just adjusting the void volume once at startup. Such void-volume adjustments can be made periodically or continuously.

The foregoing description of several preferred embodiments of the invention has been presented for purposes of illustration. It is not intended to be exhaustive or to limit the invention to the precise form disclosed, and obviously many modifications and variations are possible in light of the above teaching. For example, the number of adjustment bolts 38, the number of first LVDT's 46, and the number of second LVDT's 58 are to be chosen by the artisan. It is intended that the scope of the invention be defined by the claims appended hereto.

I claim:

1. A split-Stirling cryorefrigerator comprising:

a cylinder having a first end for warm end compression, a second end for cold end expansion, and an orifice which is disposed proximate said first end and which is in fluid communication with a gas source having a cyclic pressure;

a housing enclosing a gas spring chamber containing a gas;

a displacer assembly including a movable displacer and a movable rod; wherein said movable displacer contains regenerator material, is disposed within said cylinder, and is movable from a center position equal maximum distances towards said first end and towards said second end; wherein said movable rod has a free end disposed within said housing and an attached end disposed within said cylinder and attached to said movable displacer; and wherein said movable rod slidably and generally sealably engages said housing and said first end of said cylinder; and means for adjusting the void volume of said chamber, wherein said void-volume-adjusting means includes a temperature sensor for sensing the temperature of said second end of said cylinder, a linear-variable-differential transformer having a movable shaft extending into said chamber, and a controller for moving said movable shaft of said linear-variable differential transformer to adjust said void volume of said chamber so as to generally minimize said temperature.

2. The cryorefrigerator of claim 1, wherein said cyclic pressure of said gas source is a pressure which varies generally sinusoidally about a predetermined pressure.

3. The cryorefrigerator of claim 1, wherein said void-volume-adjusting means includes means for adjusting said void volume of said chamber so as to generally minimize the temperature of said second end of said cylinder.

4. The cryorefrigerator of claim 1, wherein said void-volume-adjusting means adjusts said void volume of said chamber during the operation of said cryorefrigerator.

5. The cryorefrigerator of claim 1, wherein said void-volume-adjusting means includes means for adjusting said void volume of said chamber so as to make the motion of said movable displacer generally centered about said center position.

6. A split-Stirling cryorefrigerator comprising:

a cylinder having a first end for warm end compression, a second end for cold end expansion, and an orifice which is disposed proximate said first end and which is in fluid communication with a gas source having a cyclic pressure;

a housing enclosing a gas-spring chamber containing a gas;

a displacer assembly including a movable displacer and a movable rod: wherein said movable displacer contains regenerator material, is disposed within said cylinder, and is movable from a center position equal maximum distances towards said first end and towards said second end; wherein said movable rod has a free end disposed within said housing and an attached end disposed within said cylinder and attached to said movable displacer; and wherein said movable rod slidably and generally sealably engages said housing and said first end of said cylinder; and means for adjusting the void volume of said chamber, wherein said void-volume-adjusting means includes a proximity sensor connected to said housing for measuring the distance to said free end of said movable rod, a linear-variable-differential transformer having a movable shaft extending into said chamber, and a controller for moving said movable shaft of said linear-variable-differential transformer to adjust said void volume of said chamber so as to make the motion of said free end of said movable rod correspond to motion of said movable displacer which is generally centered about said center position.

7. The cryorefrigerator of claim 6, wherein said void-volume-adjusting means adjusts said void volume of said chamber during the operation of said cryorefrigerator.

* * * * *